US009869104B2

(12) United States Patent
Capps

(10) Patent No.: US 9,869,104 B2
(45) Date of Patent: Jan. 16, 2018

(54) METHOD AND SYSTEM FOR MAKING A POOL APPEAR CLEANER THROUGH THE USE OF CAMOUFLAGE PATTERNS, AND PORTABLE CAMOUFLAGE POOL

(71) Applicant: Joshua Capps, Leeds, AL (US)

(72) Inventor: Joshua Capps, Leeds, AL (US)

( * ) Notice: Subject to any disclaimer, the term of this patent is extended or adjusted under 35 U.S.C. 154(b) by 70 days.

(21) Appl. No.: 13/943,904

(22) Filed: Jul. 17, 2013

(65) Prior Publication Data

US 2014/0020169 A1 Jan. 23, 2014

Related U.S. Application Data

(60) Provisional application No. 61/672,840, filed on Jul. 18, 2012.

(51) Int. Cl.
*E04H 4/00* (2006.01)
*E04H 4/14* (2006.01)

(52) U.S. Cl.
CPC ..... *E04H 4/14* (2013.01); *E04H 4/0025* (2013.01); *Y10T 156/10* (2015.01)

(58) Field of Classification Search
CPC ..... E04H 4/0025
USPC ..... 4/488–513
See application file for complete search history.

(56) References Cited

U.S. PATENT DOCUMENTS 3,354,472 A * 11/1967 Steinbeck ..... 4/503
5,521,655 A * 5/1996 Rhoad ..... 351/51
5,767,933 A * 6/1998 Hagan ..... 351/52
6,209,149 B1 * 4/2001 Song et al. ..... 4/498
6,209,586 B1 * 4/2001 Wright ..... E04H 4/1236 138/96 R
6,340,035 B2 * 1/2002 Wright ..... 138/96 R
6,588,028 B1 * 7/2003 Wu ..... 4/506
6,618,867 B2 * 9/2003 Hodak ..... E04H 4/0018 4/496
6,851,228 B1 2/2005 Forman
D538,389 S * 3/2007 Bergstedt ..... E04H 4/0018 D23/208
2001/0013373 A1 * 8/2001 Wright ..... 138/96 R
2002/0157178 A1 * 10/2002 Sejnowski ..... 4/506
2006/0021125 A1 * 2/2006 Berenson ..... 4/498
2007/0011800 A1 * 1/2007 Frost ..... E04H 4/0018 4/288
2011/0225719 A1 * 9/2011 Tong ..... 4/506
2013/0318703 A1 * 12/2013 Berenson ..... 4/494
2014/0020171 A1 * 1/2014 Jennings ..... 4/499
2014/0059760 A1 * 3/2014 Hendrick ..... 4/506
2015/0026878 A1 * 1/2015 Rambo ..... 4/499

FOREIGN PATENT DOCUMENTS

WO 2004/092023 A2 10/2004

* cited by examiner

*Primary Examiner* — Lori Baker

(74) *Attorney, Agent, or Firm* — Peter A. Koziol, Esq.; Greg M. Popowitz, Esq.; Assouline & Berlowe, P.A.

(57) ABSTRACT

A new swimming, wading and bathing pool that uses a camouflage pattern of layers to conceal debris, while helping the pool blend in to its environment. The camouflage pool is also used to conceal a person and or other objects wearing or covered in a similar camouflage pattern.

9 Claims, 3 Drawing Sheets

METHOD AND SYSTEM FOR MAKING A POOL APPEAR CLEANER THROUGH THE USE OF CAMOUFLAGE PATTERNS, AND PORTABLE CAMOUFLAGE POOL

CROSS-REFERENCE TO RELATED APPLICATIONS

This application claims the benefit of U.S. Provisional Application for Pat. No. 61/672,840 entitled METHOD AND SYSTEM FOR MAKING A POOL APPEAR CLEANER THROUGH THE USE OF CAMOUFLAGE PATTERNS, AND PORTABLE CAMOUFLAGE POOL, filed on Jul. 18, 2012, which is incorporated by reference herein in its entirety.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to swimming pools, in particular a new swimming pool and novel method for making the pool appear cleaner without relying upon filters, vacuums and other tools used in the current state of the art. It also is directed towards camouflage pools used to conceal a hunter or soldier who is wearing a congruent camouflage pattern.

Description of the Related Art

Pools have been the source of relaxation and entertainment for many years. They are also used for other purposes such as swimming, bathing, cleaning, reducing and or elevating body temperatures. They provide an environment for reduced stress and efficient exercise, providing greater resistance than air.

Clean pools are desirable and many bright inviting coatings are encouraged to make the water look clear and blue. Most above ground pools come with a solid color interior and solid color exterior, or in a tropical design with pictures of fish and cartoon like sea creatures. Present day swimming pools, in particular portable and above ground pools are often designed to mimic an environment entirely different than their surroundings and stand out like a sore thumb.

Inevitably dirt, leaves, sticks, bugs, grass, lawn clippings, pine needles, sticks, and other debris are introduced into a pool from the environment and make the water, bottom and side of the swimming pools appear dirty. In particular, matter is suspended, dissolves, sinks or floats in the water when a person, animal, toy, or other object enters the pool. The non-dissolved and suspended matter is highly visible in most pools and highly undesirable.

Suspended, sunken and floating matter is particularly noticeable with inflatable, portable and above ground pools. As these types of pools are often seasonal, dirt is highly visible when the pools are being folded or packaged for storage, and will stain or make the pool appear worn when it is unpackaged for the next season.

Although systems exist to filter debris from the top of the pool and to clean the walls and bottoms of the pool using vacuums, robots and brushes, these systems are expensive, require regular maintenance and are susceptible to wear and tear. Furthermore, many of these cleaning systems require a power source, and many are inoperable when the pool is in use. In some cases the cleaning systems may cause electrical shock, injury, or death. Strong chemical cleaners and scrubbing of pool walls, floors and bottoms puts additional strain and wear on the materials of the wall and floor surfaces.

Bright colored pools are not desirable for hunting or military applications as they expose the hunter or soldier's position, and filters and other robots may be impracticable or make the use of a swimming or relaxing pool undesirable on the base or in the field.

Camouflage is used to hide objects such as weapons, clothing, and vehicles. It is commonly used by hunters or soldiers in military operations to hide in their environment. Notably, camouflage has been recently discovered to be effective when applied to tires and sunglasses for these hunting and military applications. Rhoad, Don. F., Camouflage Eyewear, U.S. Pat. No. 5,521,655 (May 28, 1996); Hagan, Timothy, Camouflage Eyewear, U.S. Pat. No. 5,767,933 (Jun. 16, 1998); Camouflage Tire, U.S. Pat. No. 7,255,762 (Aug. 14, 2007).

However, to the knowledge of the inventor, prior to the invention disclosed herein there did not exist any swimming pools, in particular above ground swimming pools and portable pools utilizing camouflage to make the pools appear cleaner or to blend into their environment. There are also no portable camouflage pools suitable to conceal a person for hunting, camping, warfare or military operations. Moreover, the inventor is unaware of any camouflage, and in particular modern camouflage, being used in the manner and for the novel purposes herein described.

BRIEF SUMMARY OF THE INVENTION

The invention encompasses a method and system for concealing debris in swimming pools, a concealing swimming, wading and soaking pools using modern camouflage techniques. It also consists of a portable camouflage pool for camping, hunting and field operations, where a filtered water source for hiding, bathing, and recreating may not be available. In some hunting or military operations it is desirable for the water to be filled with debris as to further conceal a hunter or soldier who is hiding in the pool. Said pools may be used for recreation and adjusting body temperatures in any environment, such, but not limited to home, yard, hunting, leisure, or military environments.

Any type of camouflage can be used depending on the environment. There are a number of name brand camouflage that are effective for the object of the invention, including but not limited to: LEAF-E-FLAGE, TREE-LEAF CAMO, ASAT CAMO BY BRIGADE QUARTERMASTER, TIMBER GHOST CAMOUFLAGE, PREDATOR CAMOUFLAGE, TREEKBARK CAMOUFLAGE, MOSSY OAK TREESTAND, REAL TREE CAMO, ROCKKAFLAGE CAMO, and SKLYINE ULTIMATE CAMOUFLAGE.

However, generally, a real leaf, stick and tree pattern like THINK'N CAPPS' VANISHFLAGE has been found to be most effective and economical in most situations. In the desert or a very rocky environment, other choices of camouflage patterns, such as sand colors, are more effective.

However, due to environmental factors pools are less commonly used in those alternative environments.

Although the invention is illustrated and described herein as embodied camouflage pool and method of concealing dirt and debris, and persons within the pool using various camouflage patterns, the invention is not limited to the details shown because various modifications and structural changes may be made without departing from the invention and the equivalents of the claims. However, the construction and method of operation of the invention together with additional objects and advantages thereof will be best understood from the following description of specific embodiments when read in connection with the accompanying drawings.

Other features of the invention are set forth in the appended claims.

DETAILED DESCRIPTION OF THE INVENTION

Figure 1:
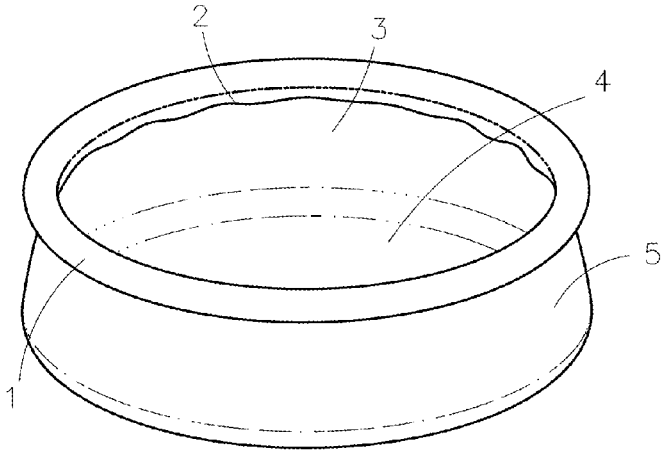
FIG. 1 shows an isomeric view of conventional inflatable type swimming pool.
Figure 2:
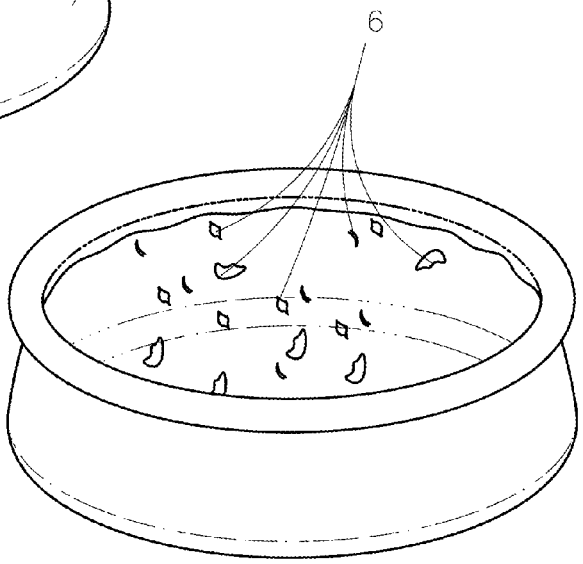
FIG. 2 show an isomeric view of conventional inflatable type swimming pool with visible debris in the water.
Figure 3:
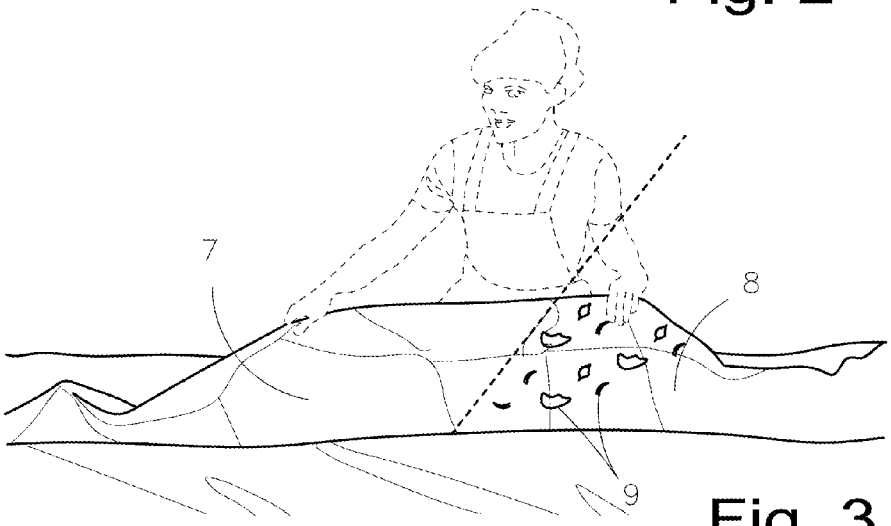
FIG. 3 shows a conventional inflatable pool being folded for storage.

The drawings show various embodiments of the instant invention. The drawings are for illustrative purposes and not intended to limit the claims of the instant inventions. FIGS. 1-3 show a conventional inflatable pool. FIGS. 1 and 2 show the conventional pool inflated and filled with liquid 3. FIG. 3 shows said conventional pool deflated for folding transportation and/or storage.

In FIGS. 1 and 2, liquid 3 filled pools pictured have reinforced rim 1 pattern-less inner-wall 2; pattern less bottom 4; and, pattern-less outer wall 5. Although not pictured, the reverse side of the bottom is also pattern-less.

The conventional pool illustrated in FIG. 1 is perfectly clean, whereas in FIG. 2. debris 6 such as leaves, sticks, bugs and dirt have been introduced. This is common in pools after use for swimming, bathing, wading, or soaking The severity of the dirt depends on the environment in which the pool is used and the cleanliness of the bathers/waders or swimmers.

FIG. 3. shows the inflatable pool of FIGS. 1 and 2 being folded for storage. A diagonal dashed line separates clean view 7 from debris view 8 by contrasting the inflatable pool's appearance when new and after being used and soiled with debris 9 such as dirt and leaves. Although a pool may be washed with soap and water after a use or season, prior to or after storage, it is very difficult and sometimes nearly impossible to remove dirt and stains. Excessive cleaning may wear or damage the material.

Figure 4:
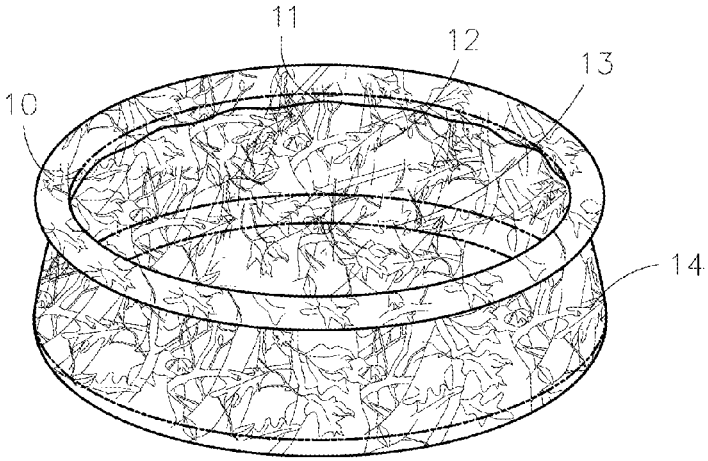
FIG. 4 shows a preferred embodiment of the instant invention as applied to the inflatable pool of FIGS. 1-3.

FIG. 4 illustrates the same inflatable pool of FIGS. 1-3, but includes a preferred camouflage pattern. Thus, liquid 13 filled pools pictured have reinforced rim 10; real leaf and tree type patterned inner-wall 11; real leaf and tree type patterned bottom 12; and, real leaf and tree type patterned outer wall 14. Although not pictured, the reverse side of the bottom also has a real leaf and tree type pattern. Although in the preferred in embodiment for most applications all surfaces in the pool have camouflage, in some applications camouflage may be applied to only certain surfaces, or different types of camouflage may be applied to different surfaces without changing the invention.

Figure 5:
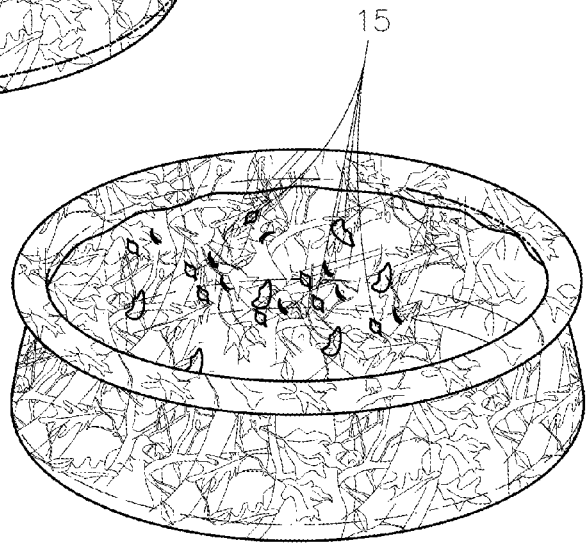
FIG. 5 shows the preferred embodiment of the instant invention with debris concealed by a real tree camouflage pattern.

FIG. 5 shows the same pool as FIG. 2., but with a preferred camouflage pattern. In the pool of FIG. 5 it is difficult to see the sticks and debris as they desirably blend in with the camouflage. The pool itself also desirably blends in with a wooded or foliated environment.

Figure 6:
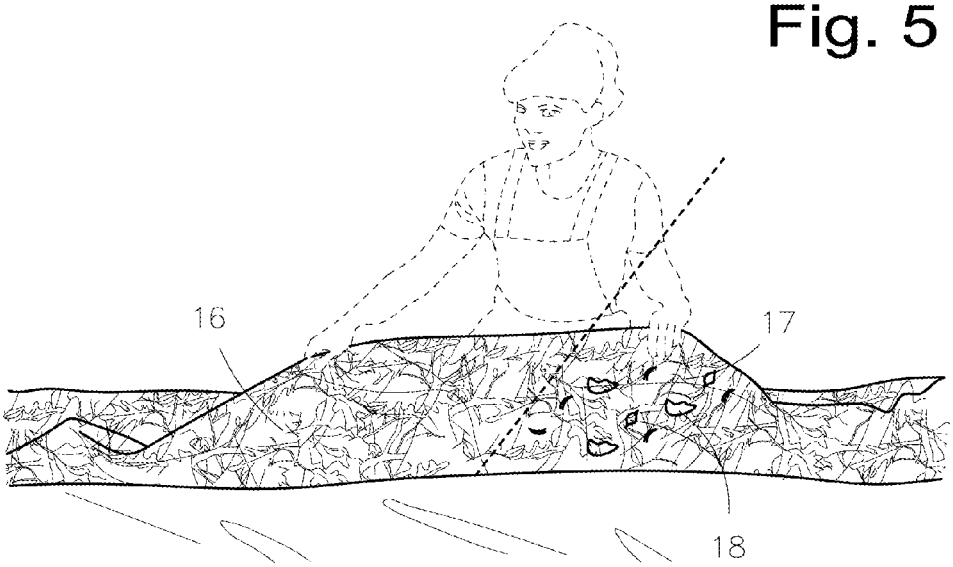
FIG. 6 shows a preferred embodiment of the inflatable variety of the instant invention with a real tree camouflage pattern being folded for storage.

FIG. 6 illustrates the inflatable pool of FIG. 5 being rolled or folded up. A dashed diagonal line separates the image illustrating how the pool appears when new 16 versus after being used 17 and having dirt and debris 18 on it. Unlike the pool in FIG. 3, the pool in FIG. 6 hides the debris and does not appear as dirty when it is being stored. It will also appear less worn and will not require as extensive washing and cleaning next season when it is removed from storage.

Figure 7:
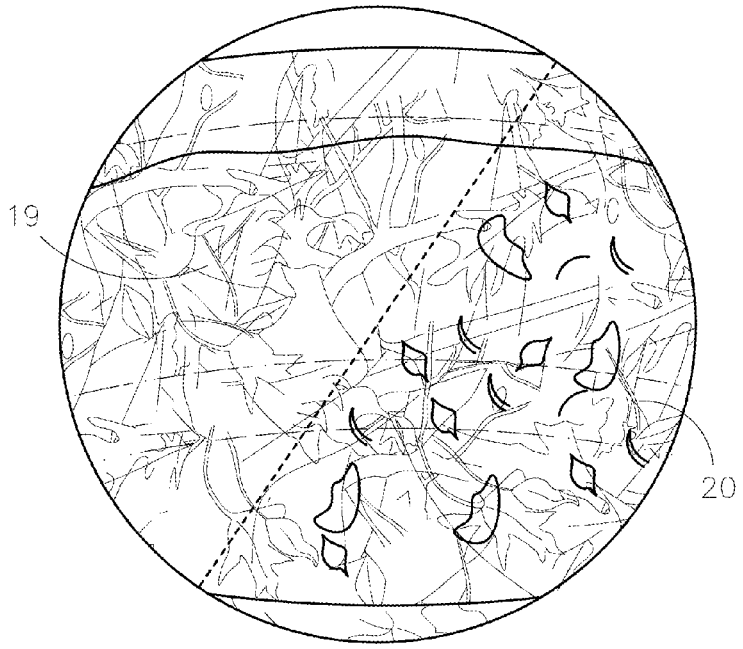
FIG. 7 shows a close up of the bottom of a pool of the instant invention, where the left hemisphere shows a new clean bottom, and the right side shows the manner in which the invention conceals debris.

FIG. 7 illustrates a close up view of the bottom of FIGS. 5 and 6 showing how the real tree pattern diminishes the contrast of the dirt with the pool bottom, and provides a more uniform and "cleaner" look than that of a conventional pool with dirt in it. The diagonal dashed line shows a view of a clean pool 19 versus a pool with debris 20. The camouflage pattern of FIG. 7 helps the dirt and debris blend in with the pool to create a more uniform and less dirty look than had the pool been made in a solid color or bright tropical ocean related design.

Figure 8:
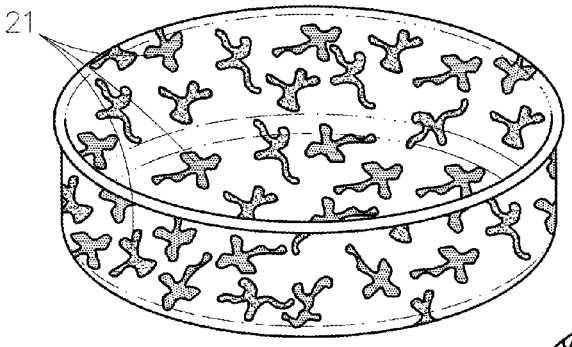
FIG. 8 shows an alternative embodiment of the instant invention using an alternative form of pool and camouflage pattern.
Figure 9:
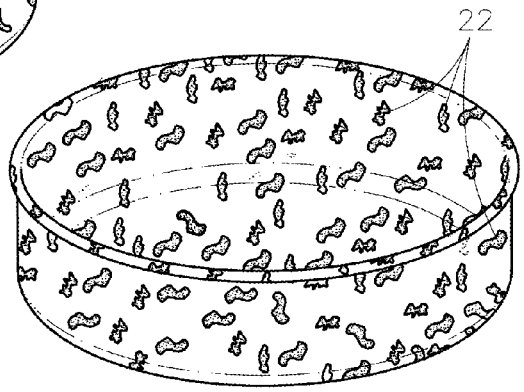
FIG. 9 shows a second alternative embodiment of the instant invention using an alternative form of pool and camouflage pattern.

FIGS. 8 and 9 illustrate alternative embodiments of the camouflage pool. Different types of camouflages 21, 22 may be used and may be applied to different types of pools from inflatable to rigid panel design, without changing the character of the instant invention. The term camouflage pattern, or pattern, as used throughout, includes, but is not limited to, the following designs: camouflage, snow, desert, forest, and animal prints. A person skilled in the art would appreciate that unique patterns are needed to blend into the various environments where the instant invention is used. The term pattern encompasses various environmental settings.

Ideal Camouflage is generally made up with layered patterns and earth tone colors with very defined lines to break up the image to blend in the environment. For example, predators like tigers and cheetahs have very defined camouflage on their fur with either lines or spots. So when the predator is on the hunt and is coming at its prey, the camouflage lines breaks up the projection of the prey's sight which causes the prey to not recognize the predator coming for his meal. The same principle applies to camouflage patterns used on swimming pools.

Through experimentation for military pool applications, it has been discovered by the inventor that forming the pattern in a Vector AI (illustration file) file made up with 5 layers is ideal, and for hunting applications approximately 18 layers is optimum to provide the swimming pool with high camouflage definition, where the width of lines and varying colors help break up the image from optical recognition and better blend in the appropriate environment. It should be noted that typical, other pool non-camouflage cartoon and sea creature designs have zero layers making up a camouflage pattern with definition of lines and repeated camouflage patterns designed for concealment.

Furthermore, it is well known that military personal endure great stress during warfare. Research studies show that swimming helps release stress in the body and mind. The use of swimming pools and swimming exercises have been shown to reduce depression. In fact, the U.S. Government provides swimming facilities on military bases in the United States. However, it is dangerous to bring bright blue or non-camouflaged pools into the field for military applications as they would easily be spotted by the enemy.

The invention solves these problem by providing a military grade camouflage swimming pool that can be used on military bases without adding a significant risk of exposing the military's position. A camouflaged pool is ideal for soldiers to use on down time for relaxation and exercising, and helps relieve stress. Consequently, deploying camouflaged swimming or relaxing pools into the military environment will prevent or reduce the likelihood of development of post traumatic stress disorder (PTSD) in many soldiers.

Additionally, when the camouflage pool is used with water that approximates the human body temperature the camouflage pool not only masks the soldier in visible light, but also in the infrared spectrum. This provides greater safety and stress relief during downtime in war.

As depicted, the preferred embodiment of the camouflage pool is circular in shape. However, the camouflage pool can take the form of many shapes, such as a long bottom wall with support walls. The same designs with no support of frames or air can be used as an in ground swimming pool liner. After applying a liquid, such as soapy water, this embodiment of the instant invention is used for sipping and sliding down extended distances..

Having thus described preferred embodiments, it should be apparent to those skilled in the art that certain advantages of the described system have been achieved. It should also be appreciated that various modifications, adaptions, and alternative embodiments thereof may be made within the scope and spirit of the present invention. The invention is further defined by the following claims.

What is claimed is:

1. An pool, comprising:

a circular bottom;

at least one inner wall connected to the circular bottom;

at least one outer wall connected to the circular bottom; and, at least one layer surface in a camouflage pattern;

wherein the circular bottom, inner wall, and outer wall are enclosed by the layer.

2. The pool recited in claim 1, further comprising a reinforced rim connecting the at least one inner wall with the at least one outer wall.

3. The pool recited in claim 2, wherein the circular bottom, inner wall, and outer wall are inflatable.

4. The pool recited in claim 2, wherein the pool is above the ground.

5. The pool recited in claim 2, wherein the camouflage pattern is comprised of at least one layer.

6. The pool recited in claim 5, wherein the camouflage pattern is five layers.

7. The pool recited in claim 5, wherein the camouflage pattern is eighteen layers.

8. The pool recited in claim 5, wherein the camouflage pattern is a sand pattern.

9. The pool recited in claim 5, wherein the camouflage pattern is a tree and leaf pattern.

* * * * *